US006475058B2

(12) United States Patent
Mammano et al.

(10) Patent No.: US 6,475,058 B2
(45) Date of Patent: Nov. 5, 2002

(54) ROTARY TOWER CRANE WITH VERTICALLY EXTENDABLE AND RETRACTABLE LOAD MANEUVERING BOOM

(75) Inventors: Jeffrey A. Mammano, Poway, CA (US); Daniel J. Aldred, Carlsbad, CA (US)

(73) Assignee: Rokenbok Toy Company, Encinitas, CA (US)

( * ) Notice: Subject to any disclaimer, the term of this patent is extended or adjusted under 35 U.S.C. 154(b) by 120 days.

(21) Appl. No.: 09/773,067

(22) Filed: Jan. 31, 2001

(65) Prior Publication Data

US 2002/0102911 A1 Aug. 1, 2002

(51) Int. Cl.[7] ..... A63H 17/12
(52) U.S. Cl. ..... 446/426; 446/425; 446/91
(58) Field of Search ..... 446/424, 425, 446/426, 427, 175, 91, 93, 88; 212/348, 349, 251, 179, 247, 333, 334, 335; 414/591

(56) References Cited

U.S. PATENT DOCUMENTS 1,865,762 A * 7/1932 Kaltenback
2,940,607 A * 6/1960 Bonanno
3,870,161 A * 3/1975 Cording ..... 212/228
3,997,061 A * 12/1976 Sano ..... 212/174
4,196,814 A 4/1980 Reich ..... 212/46 B
4,374,790 A 2/1983 McGowan ..... 264/32
5,413,515 A * 5/1995 Knox ..... 446/424
6,226,955 B1 * 5/2001 Lorrigan ..... 212/179

FOREIGN PATENT DOCUMENTS

DE 20003749 U1 * 5/2000 ..... A63H/17/12

* cited by examiner

*Primary Examiner*—Jacob K. Ackun
*Assistant Examiner*—Bena B. Miller
(74) *Attorney, Agent, or Firm*—Michael H. Jester

(57) ABSTRACT

A slewing unit mounted to the upper end of a tower rotates a combination jib and counterjib which extends in a horizontal direction about a vertical axis. A first electrical drive unit powers the slewing unit to rotate the jib to a selected angular position relative to the tower. A trolley is movable longitudinally along the jib. A second electrical drive unit moves the trolley to a selected longitudinal position along the jib. A third electrical drive unit mounted on the trolley extends and retracts a rigid elongate load lifting boom in a vertical direction. A load handler, such as a hook, clam-shell bucket or load lifting platform, is connected to the lower end of the boom.

21 Claims, 12 Drawing Sheets

ROTARY TOWER CRANE WITH VERTICALLY EXTENDABLE AND RETRACTABLE LOAD MANEUVERING BOOM

BACKGROUND OF THE INVENTION

The present invention relates to cranes for lifting loads, more particularly, to a rotary tower crane which eliminates the need for winches, cable, line and hoisting tackle.

Rotary tower cranes have long been utilized on construction sites to lift steel, concrete, large tools, and generators. A typical tower crane comprises a base bolted to a large concrete pad which supports a vertical steel framework tower that can be extended in sections. Attached to the top of the tower is a slewing unit including a ring gear and a motor for rotating a long horizontal jib or working arm which carries the load lifted by the crane. A shorter horizontal counterjib or machinery arm connects to the rear end of the jib and carries a large counterweight or ballast. A trolley runs along the jib and positions a hoisting cable or rope. An operator sitting in a cab, just below the inner end of the jib, manipulates controls for moving the jib to a preselected angular location, moving the trolley to place the hoisting cable at a predetermined radial location, and for operating the winch to raise and lower the hoisting tackle. Typically the operator works in conjunction with construction crew who manually connect and disconnect the hoisting tackle to and from a given load. Therefore, in most instances, precision location of the hoisting tackle and/or the load carried thereby, is not required.

There are some situations in which it would be desirable for the operator of a tower crane to be able to handle loads without the assistance of a member of the construction crew. This is very difficult to accomplish if a lifting cable or line is utilized due to its inherent tendency to twist and swing and therefore the hoisting tackle is difficult to correctly position. Furthermore, conventional hoisting tackle typically includes a hook, a shackle, and other means of attachment that must be manually connected to, and disconnected from, the load at the load lifting and load depositing areas, respectively, of the construction site. One such situation involves a toy tower crane that is remotely manipulated by a player through hard wired or radio control.

SUMMARY OF THE INVENTION

Therefore, it is the primary object of the present invention, to provide an improved crane.

It is another object of the present invention to provide an improved rotary tower crane.

It is still another object of the present invention to provide a generic boom extender module that may be used in a crane, and in other environments where it is desirable to provide bilinear actuation.

Still another object of the present invention is to provide a radio-controlled toy tower crane particularly adapted for use in a simulated miniature construction site or industrial environment.

In accordance with the present invention, a crane has a jib that extends in a horizontal direction and a trolley movable along the jib in a longitudinal direction. A first drive unit moves the trolley to a selected longitudinal direction along the jib, a second drive unit mounted on the trolley extends and retracts a rigid load maneuvering boom in a vertical direction. A load handler is mounted to the lower end of the boom.

In accordance with the present invention, a tower crane has a jib that extends in a horizontal direction. A counterjib extends in a horizontal direction and is connected to the jib. The jib and counterjib are supported by a stewing unit mounted to the upper end of the tower for powered rotation of the jib and the counterjib about a vertical axis. A first electrical drive unit powers the stewing unit to rotate the jib to a selected angular position relative to the tower. A trolley is movable along the jib. A second electrical drive unit powers the trolley to a selected longitudinal position along the jib. A third electrical drive unit mounted on the trolley extends and retracts a load lifting boom along a vertical direction. A load handler is mounted to a lower end of the boom.

The present invention also provides a boom extender module that includes an elongate guide sleeve having an opening in a sidewall thereof. A frame is mounted to the guide sleeve adjacent to the opening. A cog is rotatably supported on the frame so that the teeth of the cog penetrate the opening in the guide sleeve.

DESCRIPTION OF THE PREFERRED EMBODIMENT

Figure 1:
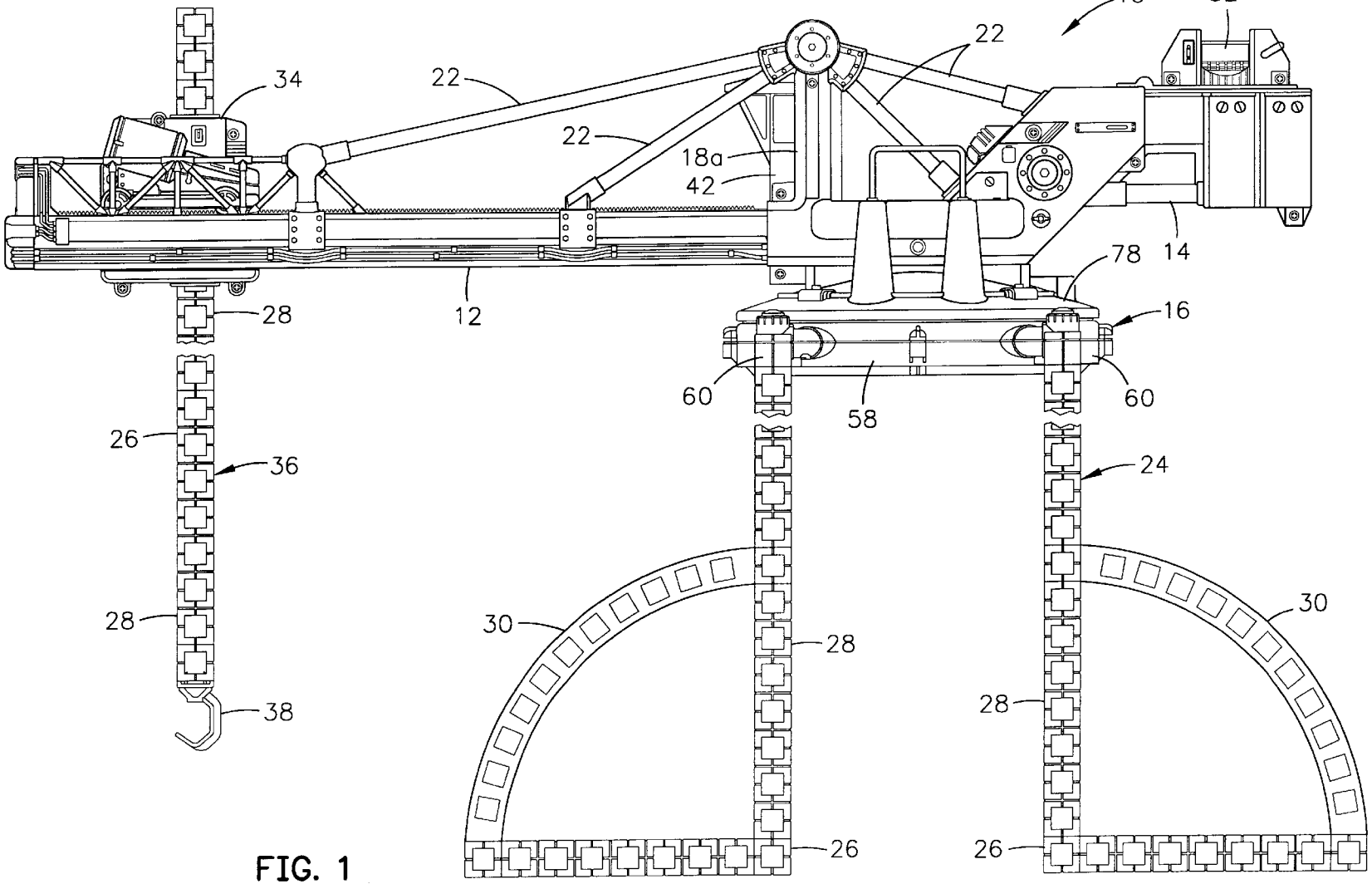
FIG. 1 is a side elevation view of a preferred embodiment of a rotary tower crane constructed in accordance with the present invention. The tower is fragmented in this figure.

The preferred embodiment of the rotary tower crane described hereafter is designed to be used as a toy in a simulated miniature construction site or industrial environment as part of the ROKENBOK® toy system. That system includes a plurality of remotely controlled vehicles that are operated by children or adults ("players") to accomplish tasks such as lifting, scooping, dumping, leveling, pushing, hauling and otherwise transporting materials such as slotted marbles. The simulated construction site or industrial environment typically comprises a series of ramps and platforms supported by proprietary building blocks, beams and other construction units. The construction site or industrial environment may also include elevators, bridges, chutes and other stationary structures and machines. The stationary machines may be powered, and remotely controlled, to lift building materials or vehicles, dump building materials, and so forth.

The stationary machines of the ROKENBOK toy system may also include a remotely-controlled motorized pumping station for pumping slotted marbles from a hopper through a conduit. The system may also include a remotely-controlled motorized conveyor for moving elements such as slotted marbles from a hopper upwardly on a ramp. When the marbles reach the top of the ramp, the marbles may fall into a bin that empties into a toy dump truck vehicle positioned beneath the same, or into a skip loader.

A recent addition to the ROKENBOK toy system is a remotely controlled monorail train. Elevated monorail track can be constructed out of proprietary snap-together blocks and beams. The beams may be straight, curved or inclined.

In the ROKENBOK toy system, a plurality of hand-held control units or pads are connected by wires to a central station which transmits radio frequency (RF) signals to the plurality of vehicles and stationary machines so that they can be simultaneously independently operated by one or more players. A unique color-coded and numbered key is inserted into a socket in each vehicle or stationary machine to close contacts to reset a micro-controller in the vehicle or stationery machine. When the vehicle or stationary machine receives an individual address resulting from the closure of a control pad switch within a predetermined time period thereafter, the vehicle or stationary machine is operated in the future by commands only from that control pad. The manual manipulation of switches in the control pad thereafter control the operation of motors that, for example, cause the selected vehicle to move forward, rearward, left, right, and to move its scooper (for example) upwardly and downwardly (and left and right). Specialized circuitry in the ROKENBOK toy system allows for low cost simulation of both proportional steering and motion without the use of complex and expensive servo control mechanisms.

The following U.S. patents describe the details of the ROKENBOK toy system, which is commercially available world-wide, and their entire disclosures are specifically incorporated herein by reference: U.S. Pat. No. 5,879,221 of Barton et al. entitled "Toy Bulldozer with Blade Float Mechanism"; U.S. Pat. No. 5,885,159 of DeAngelis entitled "System for, and Method of, Controlling the Operation of Toys"; U.S. Pat. No. 5,888,135 of Barton, Jr., et al. entitled "System for, and Method of, Collectively Providing the Operation of Toy Vehicles"; U.S. Pat. No. 5,944,607 of Crane entitled "Remote Control System for Operating Toys"; U.S. Pat. No. 5,944,609 of Crane et al. entitled "Remote Control System for Operating Toys"; U.S. Pat. No. 5,964,640 of Barton et al. entitled "Toy Dump Truck with Automatic Dumper Mechanism"; and U.S. Pat. No. 5,989,096 of Barton et al. entitled "Toy Forklift Vehicle with Improved Steering."

Referring to FIG. 1, the preferred embodiment of the present invention comprises a radio-controlled rotary tower crane 10. Most of the tower crane 10 is constructed of colorful injection molded ABS plastic held together by adhesive, sonic welding, fasteners, or other suitable means. Some of the parts, such as electric motors, axles, electrical contacts and wires are made of suitable metal. The control circuit of the tower crane 10 that is described hereafter is made of electronic components connected on circuit boards in a conventional manner.

Figure 2:
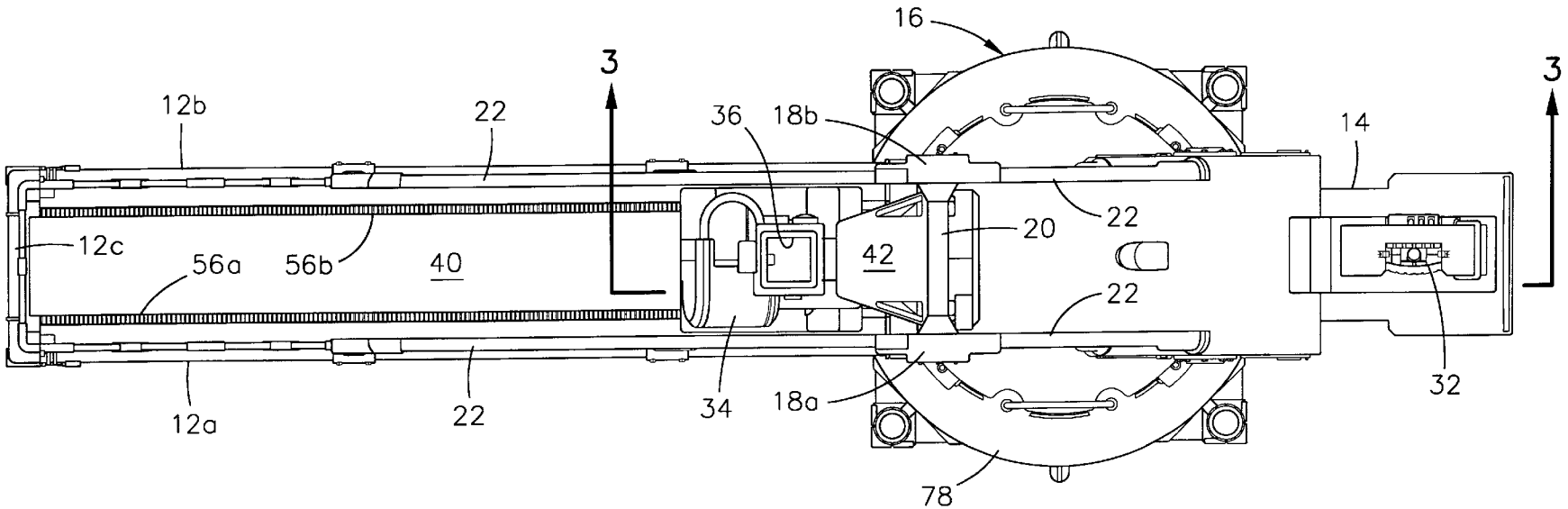
FIG. 2 is a top plan view of the rotary tower crane of FIG. 1.

Referring still to FIG. 1, the tower crane 10 includes long horizontal jib 12 and a shorter horizontal counterjib 14. The inner end of the jib 12 is connected to the inner end of the counterjib 14 to provide a single longitudinally extending arm. The counterjib 14 is mounted on top of a stewing unit 16. Referring to FIGS. 1 and 2, a pair of laterally spaced vertically extending masts 18*a* and 18*b* extend upwardly from either side of the inner end of the counterjib 14 and are connected at their upper ends by a cross-tie 20 (FIG. 2). A plurality of jib ties 22 (FIG. 1) extend at an angle downwardly from the upper ends of the mast 18*a* and 18*b* and connect to the jib 12 and counterjib 14 at longitudinally spaced locations therealong.

Slewing unit 16 is supported by a tower 24 (FIG. 1) constructed of proprietary ROKENBOK blocks 26, straight beams 28 and curved beams 30. The blocks and beams preferably have the configuration illustrated in U.S. Pat. No. 5,826,394 of Barton, Jr. et al. entitled "Basic Building Blocks for Constructing Complex Building Structure" the entire disclosure of which is specifically incorporated herein by reference. That patent also shows other structures, such as vehicle ramps, building roofs, awnings and corbels that can be disposed in a cooperative relationship with at structure formed from the blocks and beams. Each block 26 can only connect to either end of a beam 28 and visa versa.

A key socket 32 (FIG. 1) is formed in the counterjib 14 and receives a unique and color-coded and numbered ROKENBOK key (not illustrated). When the key is inserted into the socket 32 by a player, the player can manipulate manual controls on a hand-held ROKENBOK control pad (not shown) to select the tower crane 10 and activate the same. Details of the key socket 32 and the ROKENBOK key which is plugged into the same, may be found in the aforementioned U.S. Pat. No. 5,888,135 of Barton, Jr., et al.

A trolley 34 (FIGS. 1 and 2) is longitudinally reciprocable along the jib 12. An elongate rigid load maneuvering boom 36 can be raised and lowered through a square cross-section aperture 37 (FIG. 3) that extends through the trolley 34 by a boom extender nodule contained within the trolley 34.

The player can manipulate controls on the hand-held ROKENBOK control pad to move the jib 12 (FIG. 1) to a preselected angular location relative to the tower 24, move the trolley 34 to place the boom 36 at a predetermined radial location, and for operating the boom extender module within the trolley 34 to raise and lower the boom 36. A loader handler such as hook 38 (FIG. 1) is connected to the lower end of the boom 32.

As best seen in FIG. 2, the jib 12 includes laterally spaced, parallel extending horizontal working arms 12*a* and 12*b* connected at their outer ends by a cross-piece 12*c*. As the trolley 34 moves longitudinally back and forth along the working arms 12*a* and 12*b*, the vertically extending boom 36 travels along the large, longitudinally extending opening 40 bounded by the working arms 12*a* and 12*b* and the cross-piece 12*c*. A simulated operator cab 42 (FIGS. 1, 2 and 3) is positioned on top of the inner end of the counterjib 14 beneath the cross-piece 20.

The boom 36 is constructed of proprietary ROKENBOK blocks 26 and straight beams 28 which are snapped together to provide the desired length. Square openings 36*a* (FIG. 14) are molded in each face of each block 26 and beam 28. These openings may receive the teeth of a cog 44 (FIG. 3) so that the boom 36 can be extended or retracted by rotation of the cog 44.

Figure 15:
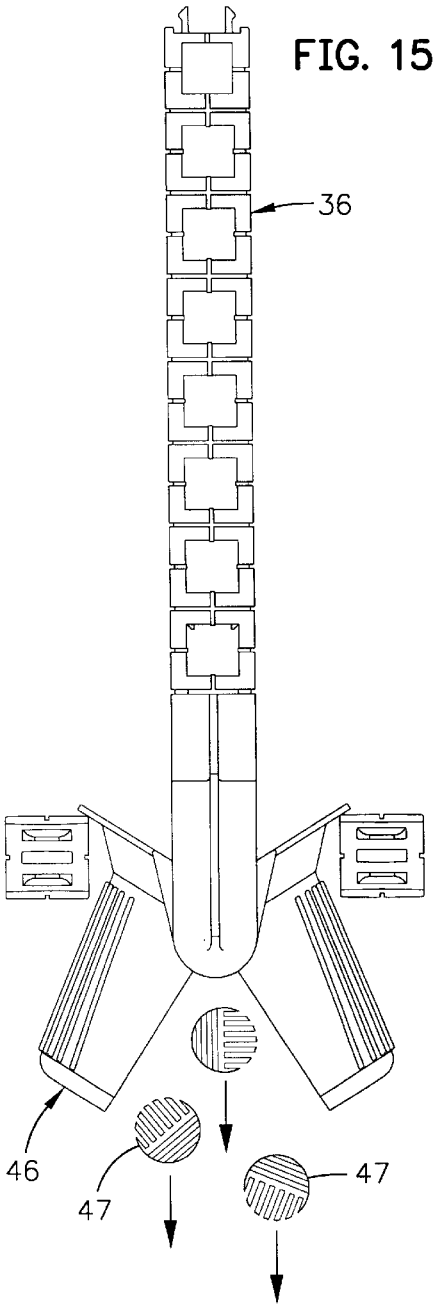
FIG. 15 is an enlarged fragmentary side elevation view of the boom showing a clam-shell bucket connected to the lower end thereof and engaging two parallel beams to pivot the halves of the clam-shell bucket to their open positions.
Figure 16:
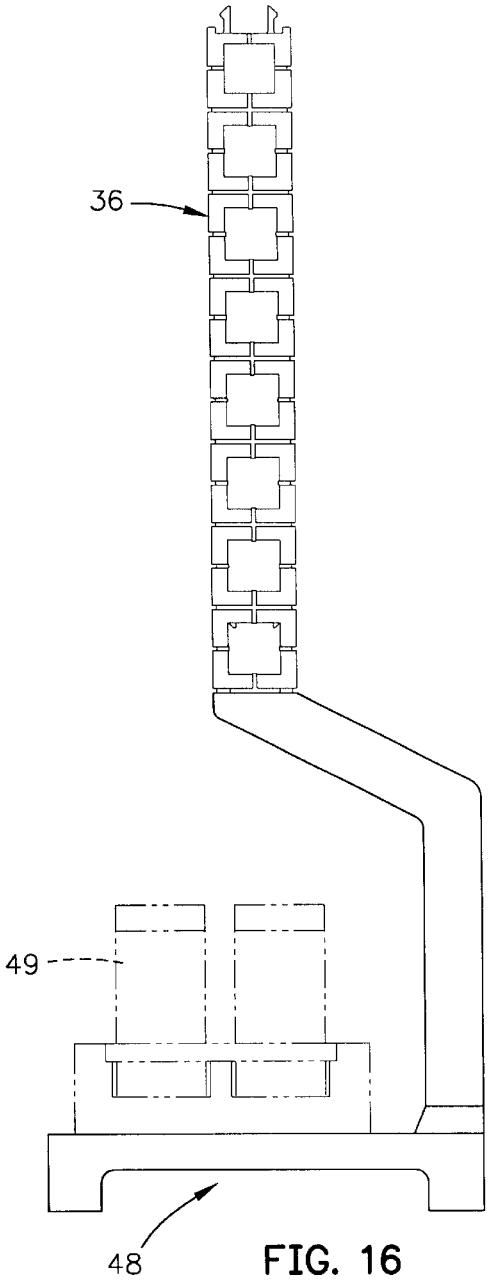
FIG. 16 is a fragmentary side elevation view showing a lifting platform attached to the lower end of the boom with a load situated on the platform illustrated in phantom lines.
Figure 17A:
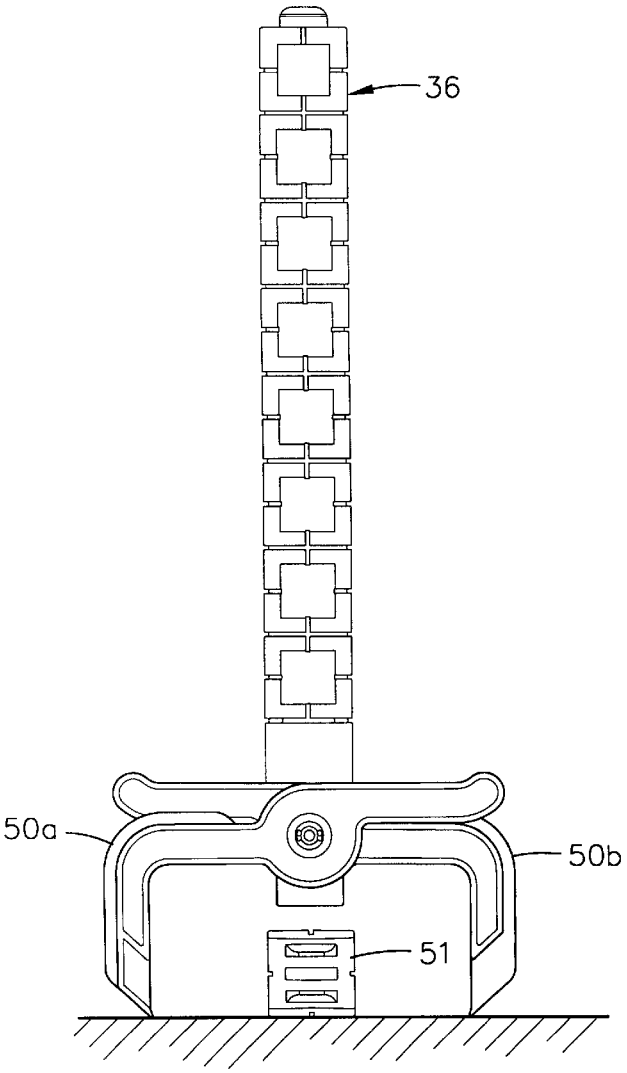
FIG. 17A and FIG. 17B illustrate the open and closed configurations of spring biased claws connected to the lower end of the boom for grasping a construction piece.
Figure 17B:
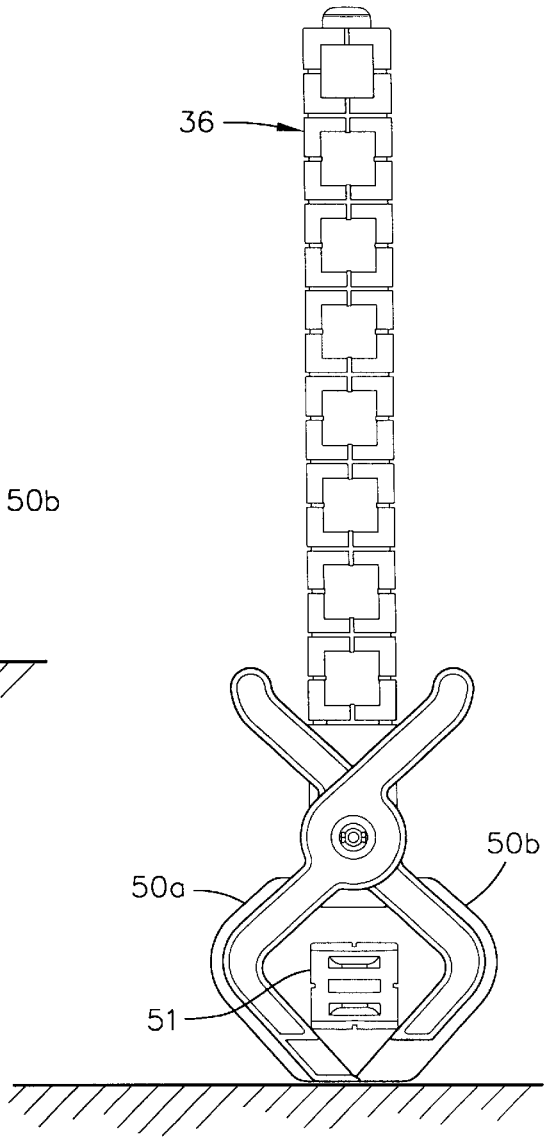

The load handler at the lower end of the boom 36 could be a hook, magnet, or adhesive pad. Preferably, the load handler is either a clam-shell bucket 46 (FIG. 15), a lifting platform 48 (FIG. 16) or a spring-biased pair of interleaving claws 50*a* and 50*b* (FIGS. 17A and 17B). The bucket 46 can engage spaced apart beams to dump a plurality of marbles 47. The platform 48 can lift, for example, construction pieces 49, or another ROKENBOK vehicle. The claws 50*a* and 50*b* can be spread apart and cocked, and will snap together and trap a construction piece 51 to be lifted upon contact with ground or other support structure.

Figure 3:
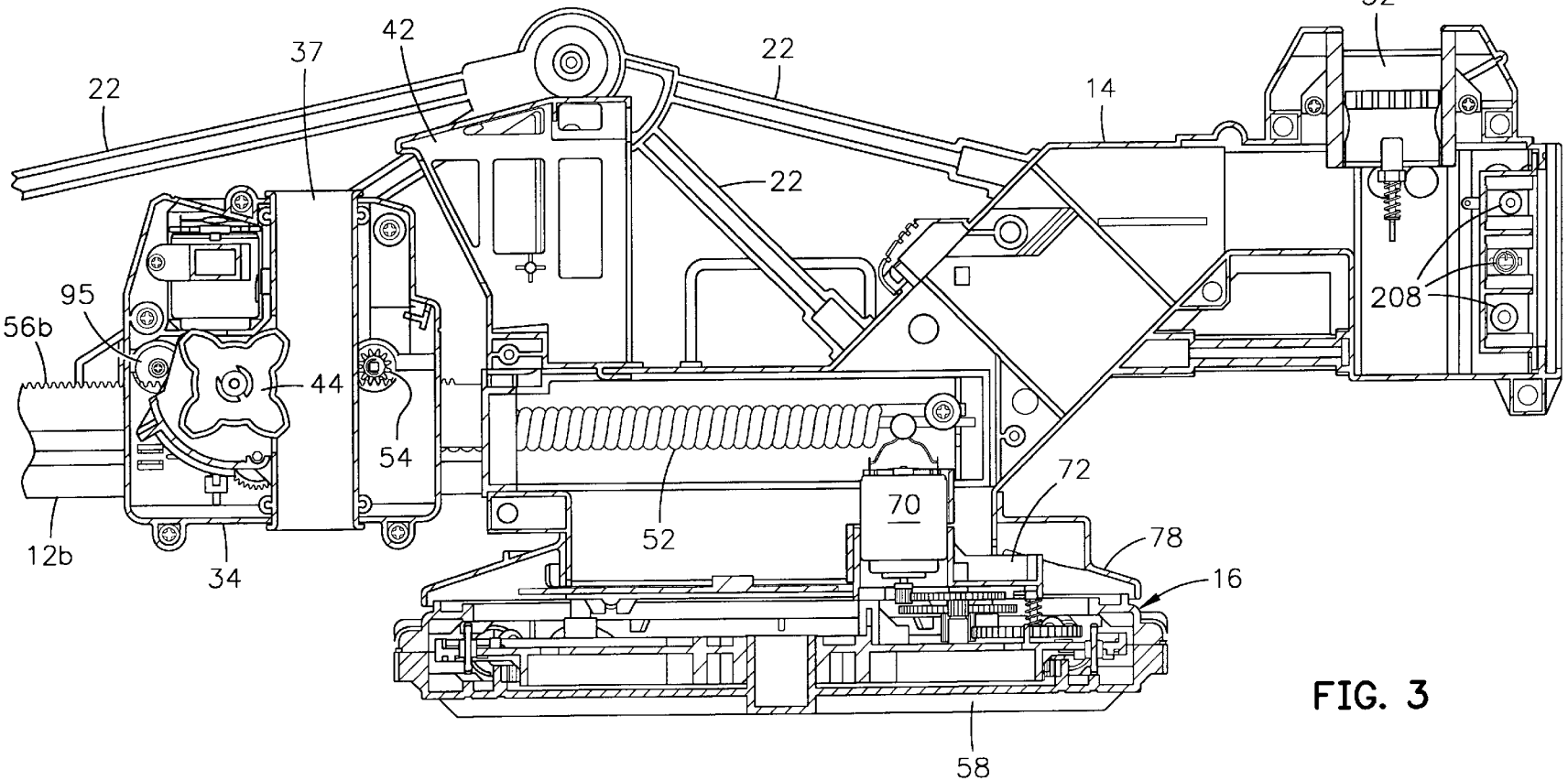
FIG. 3 is an enlarged fragmentary sectional view of the rotary tower crane taken along line 3—3 of FIG. 2. The vertical load maneuvering boom of the crane is not shown in this figure.

Referring to FIG. 3, the boom extender module (hereinafter described) which is inside the trolley 34 receives electric power from a control circuit 200 (FIG. 18) hereinafter described through a springy coiled cable 52 that extends within the working arm 12*b* (FIG. 2). The trolley 34 has a pinion gear 54 (FIG. 3) that rides on one of two parallel extending rack gears 56*a* and 56*b* on the working arms 12*a* and 12*b*, respectively. The pinion gear 54 engages the rack gear 56*b* to move the trolley 34 radially inwardly and outwardly along the jib 12, in accordance with commands sent by the player through actuation of the ROKENBOK control pad. As explained hereafter, trolley 34 includes an electrical drive unit that rotates the pinion gear 54 to move the trolley 34 to a selected longitudinal position along the jib 12. This determines the radial location of the boom 36. The cog 44 is rotated by another electrical drive unit which is part of the boom extender module hereafter described. This electrical drive unit extends and retracts boom 36 in the vertical direction.

Figure 4:
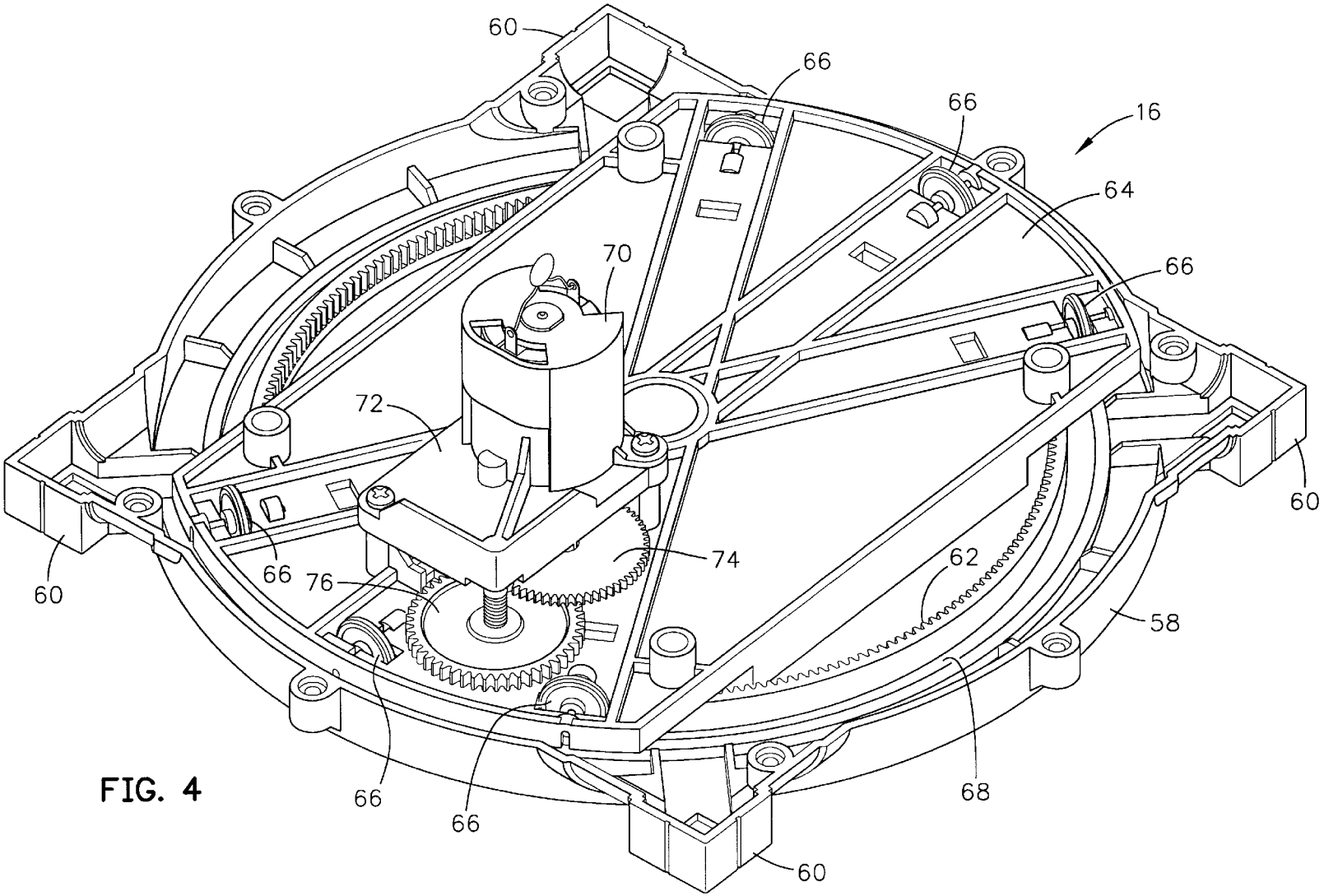
FIG. 4 is an enlarged isometric view of a portion of the stewing unit of the tower crane of FIG. 1.

Details of the slewing unit 16 are illustrated in FIGS. 3 and 4. The slewing unit 16 is mounted on the upper end of the tower 24 and supports the inner end of the jib 12 and the inner end of the counterjib 14 for powered rotation of these components about a vertical axis extending down the center of the slewing unit 16. The slewing unit 16 includes an electrical drive unit hereafter described for rotating the jib 12 (and the counterjib 14) to a selected angular position relative to the tower 24 in accordance with commands sent by the player through actuation of the ROKENBOK control pad. The slewing unit 16 includes a horizontally extending, generally rectangular base 58 having four sockets 60 (FIG. 4) formed on the corners thereof for receiving and connecting to beams 28 of the tower 24 as seen in FIG. 1. A ring gear 62 (FIG. 4) is mounted inside the base 58 of the slewing unit 16. A turntable 64 spans the base 58 and is supported for rotation about the vertical axis of the slewing unit 16 by six wheels 66. The wheels 66 are supported by axles, connected to the turntable 64. The wheels 66 ride in a circular track 68 formed in the base 58 of the slewing unit 16. An electric motor 70 is supported on a gear train support 72. The shaft of the motor 70 drives a reduction gear train carried by the gear train support 72 that includes meshing pinion and spur gears, including spur gears 74 and 76. A pinion gear 77 FIG. 5A) on the same shaft 82 as the spur gear 76 engages the ring gear 62 for rotating the turntable 64 when the motor 70 is energized. The lower portion of the counterjib 14 is coupled to the turntable 64 so that the jib 12 and counterjib 14 rotate therewith. The slewing unit 16 includes a top cover 78 best seen in FIGS. 1, 2 and 3.

The slewing unit 16, as well as the other electrical drive units described hereafter, include slip clutch assemblies to prevent damage to their motors and/or drive trains. This can occur, for example, if a player were to manually rotate the jib 12, pull up or down on the boom 36, or push the trolley 34 back and forth along the jib 12. In addition, if any of these components were to encounter an obstruction to prevent their movement while their motors were energized, damage to their motors and/or drive trains could result in the absence of the slip clutch assemblies.

Figure 5A:
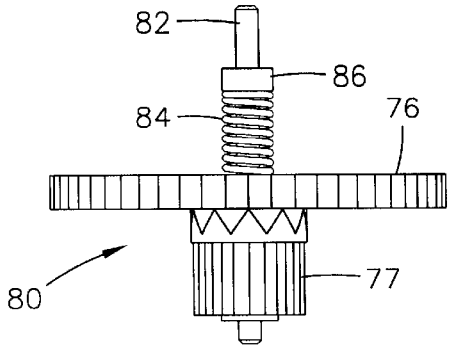
FIG. 5A is an enlarged side elevation view of the slip clutch assembly of the stewing unit in its engaged position.
Figure 5B:
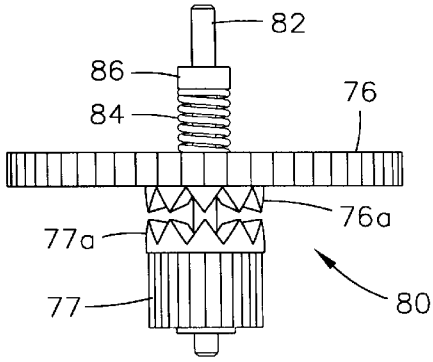
FIG. 5B is an enlarged side elevation view of the slip clutch assembly of the stewing unit in its disengaged position.

Referring to FIGS. 5A and 5B, the slip clutch assembly 80 for the slewing unit 16 includes complementary serrated portions 76*a* and 77*a* formed on the underside of the spur gear 76 and the upper side of the pinion gear 77, respectively. The position of the pinion gear 76 on its drive shaft 82 is fixed. The pinion gear 77 engages the ring gear 62 to rotate the turntable 64 and the jib 12 and counterjib 14 along with it. The spur gear 76 is mounted on the drive shaft 82 for reciprocal sliding motion along the longitudinal axis of the drive shaft 82. A coiled spring 84 is positioned between the spur gear 76 and a fixed shoulder 86 on the drive shaft 82. Should a player hold the jib 12 to prevent rotation thereof while the motor 70 is energized, the serrated portion 76*a* will disengage and rise upwardly from the serrated portion 77*a*, compressing the coil spring 84. The motor 70 can continue to run without damage to either the motor 70 or the gear drive train. Once the player releases the jib 12, the spring 84 will expand, forcing the spur gear 76 and its serrated portion 76*a* downwardly to re-engage the serrated portion 77*a*. This re-establishes the driving connection between the motor 70 and the ring gear 62 so that the jib 12 will continue to turn as a result of energization of the motor 70.

Figure 6:
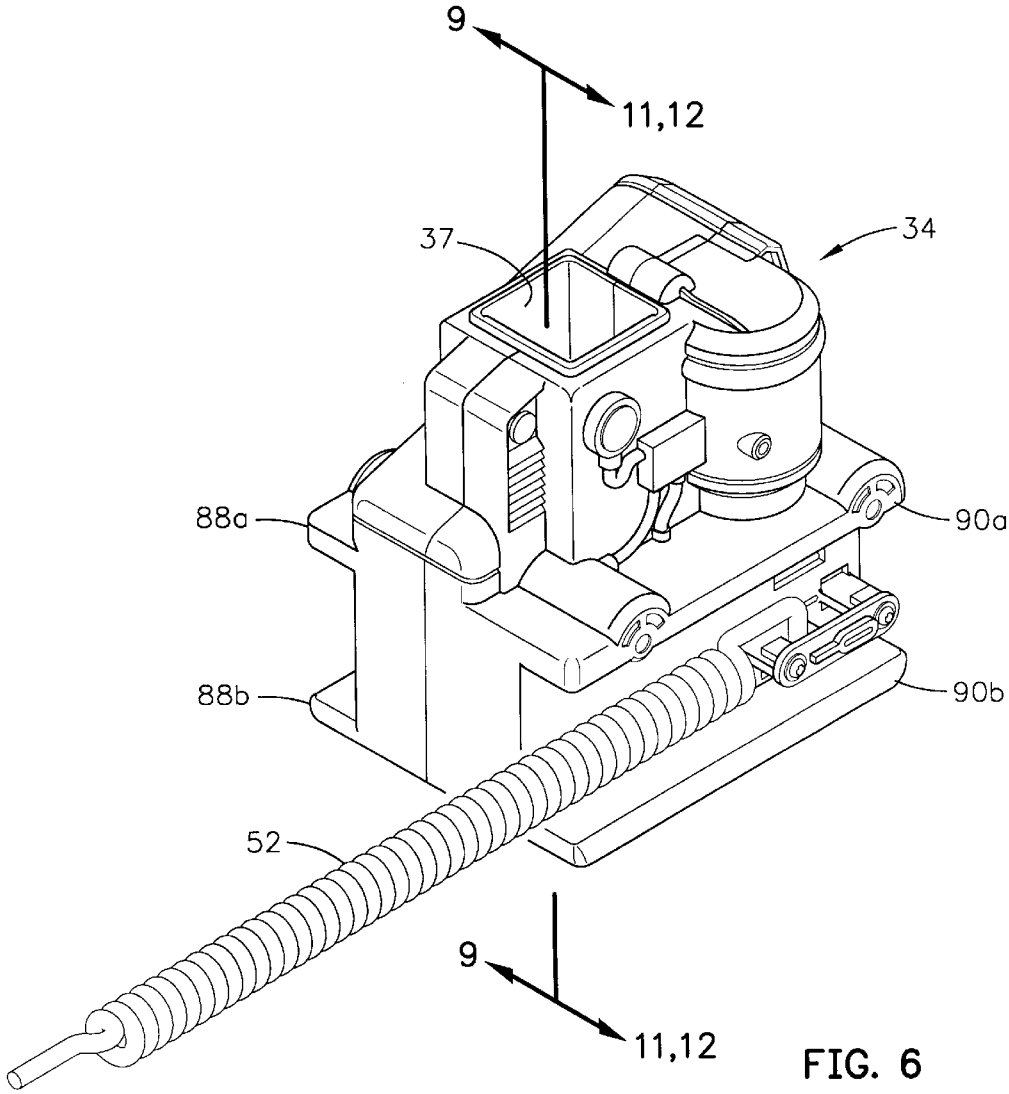
FIG. 6 is an enlarged isometric view of the rear side of the trolley of the rotary tower crane of FIG. 1.
Figure 7:
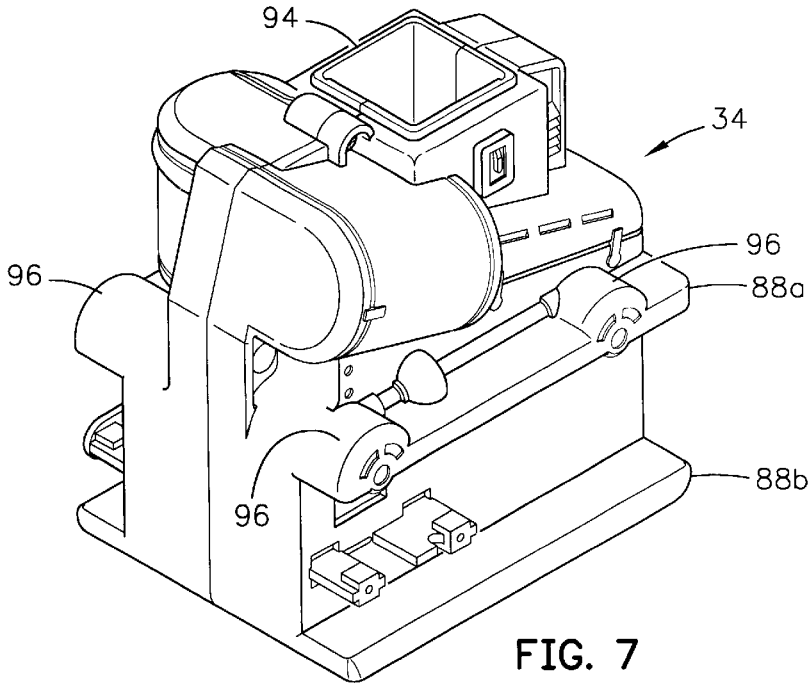
FIG. 7 is an enlarged isometric view of the front side of the trolley of the rotary crane of FIG. 1.

FIG. 6 shows further details for the exterior configuration of the trolley 34. The trolley 34 includes four laterally extending flanges 88*a*, 88*b*, 90*a* and 90*b*. Flanges 88*a* and 88*b* surround the working arm 12*a* while the flanges 90*a* and 90*b* surround the working arm 12*b*. The boom extender module 92 (FIG. 8) is mounted inside the housing of the trolley 34. The boom extender module 92 includes an elongated hollow rectangular guide sleeve 94 providing the aperture 37 (FIG. 3) through which the boom 36 is vertically driven. Four rollers 95 (FIG. 11) are mounted on axles inside flared fenders 96 formed in the upper flanges 88*a* and 90*a*. The rollers 95 roll along on the smooth upper surfaces of the working arms 12*a* and 12*b* (FIG. 2) just outside the rack gears 56*a* and 56*b*. Only the lone pinion gear 54 (FIGS. 3 and 9) drives the trolley 34 by engaging the rack gear 56*b* on the inside of its adjacent roller 95. The rack gear 56*a* exists because only a single mold is used to make both of the working arms 12*a* and 12*b*.

Figure 8:
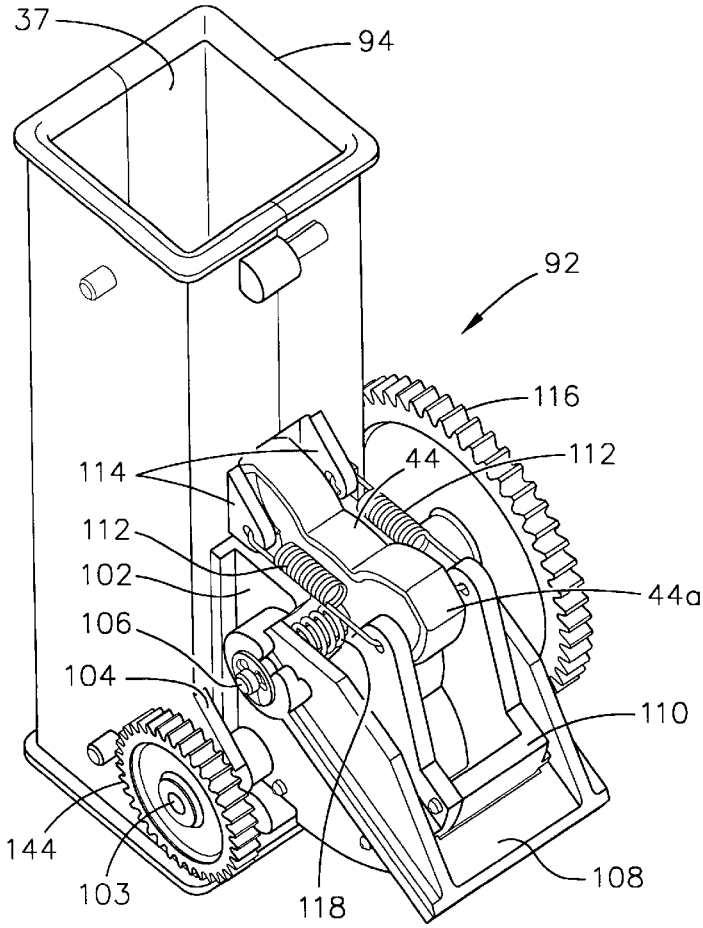
FIG. 8 is an enlarged isometric view of the boom extender module that is incorporated into the trolley of the rotary tower crane of FIG. 1.
Figure 14:
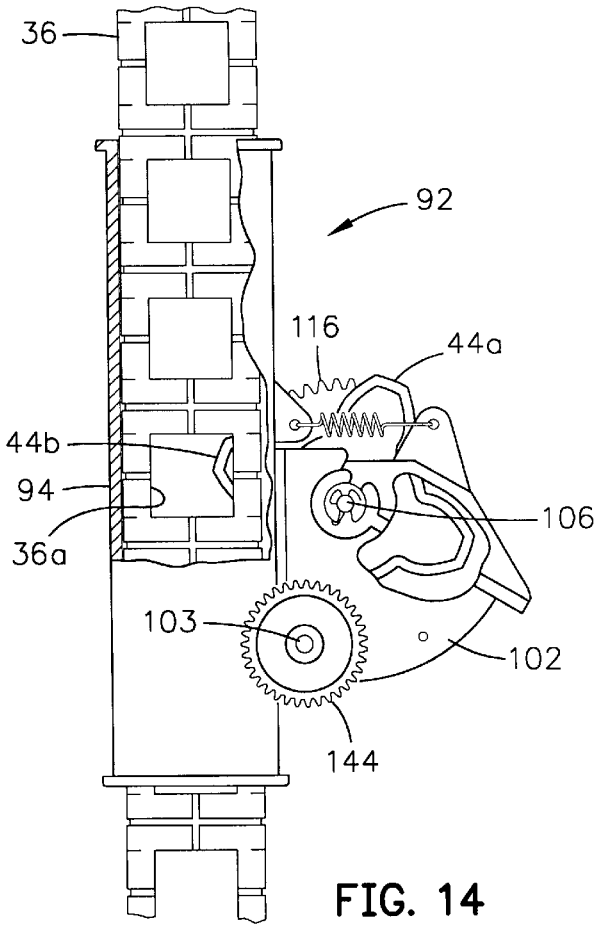
FIG. 14 is a fragmentary side elevation view of the boom extender module showing the boom in the sleeve thereof.

FIGS. 8 and 14 illustrate details of the boom extender module 100 which is incorporated into the trolley 34. It comprises the rectangular guide sleeve 94 through which the boom 36 (FIG. 14) is extended and retracted along with the drive mechanisms for extending and retracting the boom 36. These drive mechanisms include the cog 44 driven through a reduction gear drive. The cog 44 has four equally spaced teeth such as 44*a* (FIG. 8). The cog 44 rotates through an opening in the side wall of the guide sleeve 94. The cog 44 is rotated by an electrical drive unit described hereafter. Each tooth of the cog 44, such as 44*b* (FIG. 14), penetrates a corresponding rectangular opening such as 36*a* in the boom 36. As the cog 44 rotates, the boom 36 is driven through the guide sleeve 94. The combination of the boom extender module 100 and the boom 36 in effect provide a rack and pinion drive mechanism. The inside dimensions of the aperture 37 through the guide sleeve 94 are slightly greater than the outside dimensions of the boom 36. Preferably the boom 36 glides easily, but snugly, through the sleeve 94. This minimizes the amount of angular tilt on the remote end of the boom 36. However, it is possible for the cog 44 to get into a position such that the boom 36 cannot be initially loaded through the aperture 37 in the guide sleeve 94. Therefore, the rotary support for the cog 44 is mounted so that the cog 44 can move away from the guide sleeve 94 and then snap back into position when one of its teeth penetrates one of the openings 36*a* of the boom 36.

Referring to FIG. 8, a frame 102 pivots about an axle 103 that rotates in a pair of trunnions 104 formed on either side of the lower end of the guide sleeve 94. The cog 44 is journaled on a shaft 106 which extends through a pair of snap-together frame pieces 108 and 110. The entire assembly of pieces 102, 108 and 110 is pivoted toward the sleeve 94 about the axle 103 by a pair of coiled springs 112. The springs 112 connect between another pair of trunnions 114 formed on the sleeve 94 and corners of the frame piece 110. The shaft 106 which carries the cog 44 is driven by spur gear 116 mounted on the shaft 106. The cog 44 and the spur gear 106 have mating engaging splined portions which, together with a coiled spring 118 mounted about the shaft 106, provide a slip clutch assembly.

Figure 9:
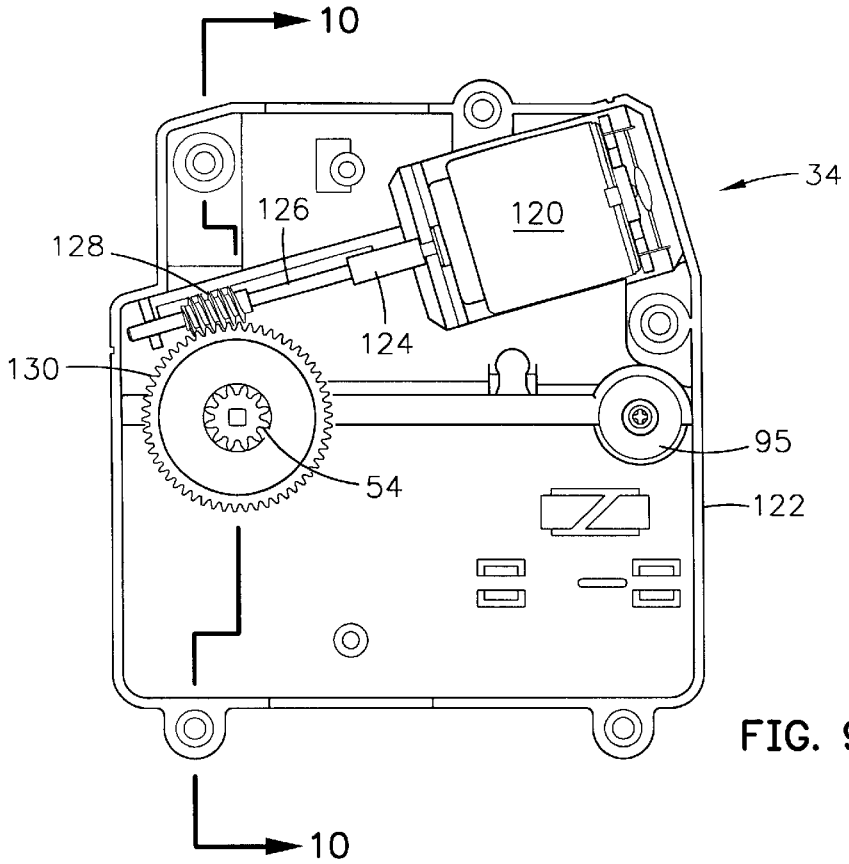
FIG. 9 is a vertical sectional view of the trolley of the rotary tower crane of FIG. 1 taken along line 9—9 of FIG. 6.
Figure 10:
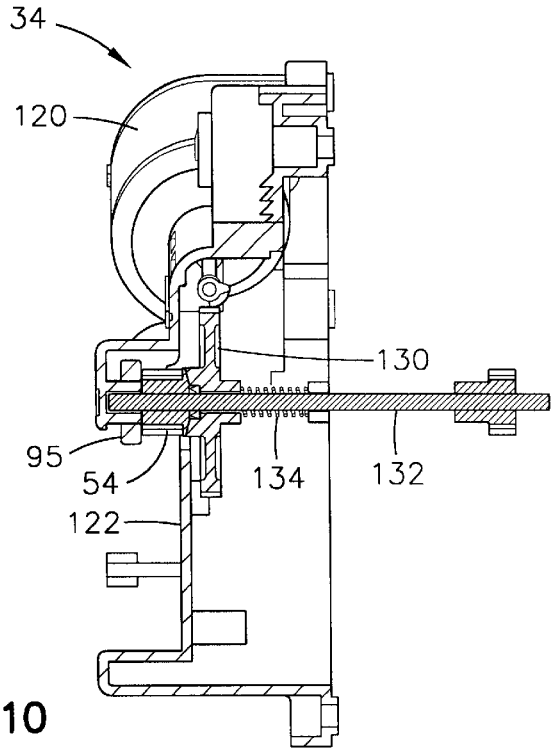
FIG. 10 is a vertical sectional view of the trolley taken along line 10—10 of FIG. 9.

FIGS. 9 and 10 illustrate details of the electrical drive unit that moves the trolley 34 to a selected longitudinal position along the jib 12. This electrical drive unit includes a motor 120 mounted in an inclined position within the outer housing 122 of the trolley. The motor 120 is connected via coupling 124 (FIG. 9) to a shaft 126 having a worm gear 128 mounted thereon. The worm gear 128 is rotatably engaged with a spur gear 130. As best seen in FIG. 10, the spur gear 130 is mounted on a shaft 132 on which pinion gear 54 is rigidly mounted. The pinion gear 54 engages the rack gear 56*b* (FIG. 2). The outer face of the spur gear 130 and the inner face of the pinion gear 54 have mating splined or serrated portions which, together with a coiled spring 134 surrounding the shaft 132, provide a slip clutch assembly.

Figure 11:
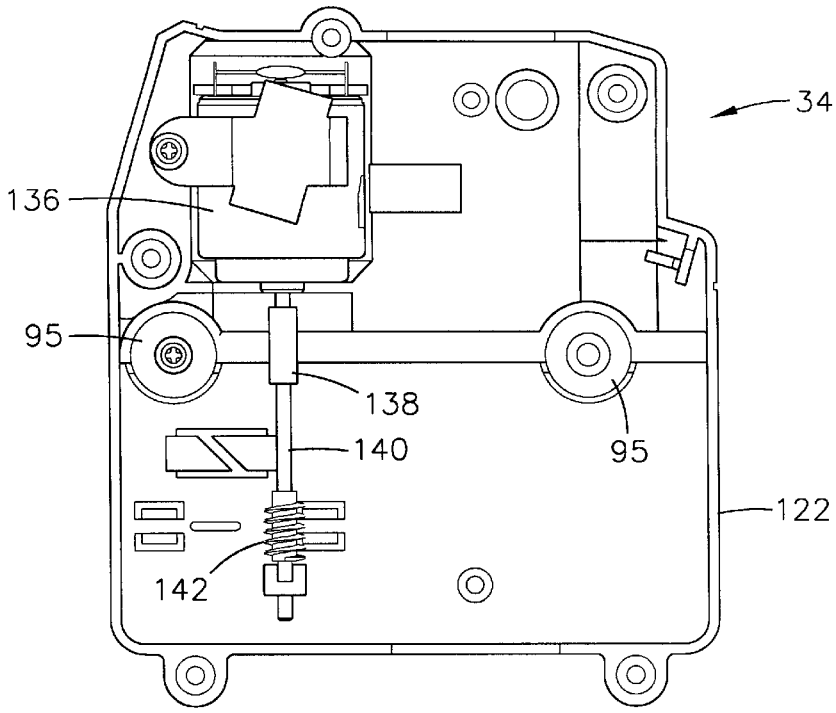
FIG. 11 is a vertical sectional view of the trolley taken along line 11—11 of FIG. 6 without the boom extender module.
Figure 12:
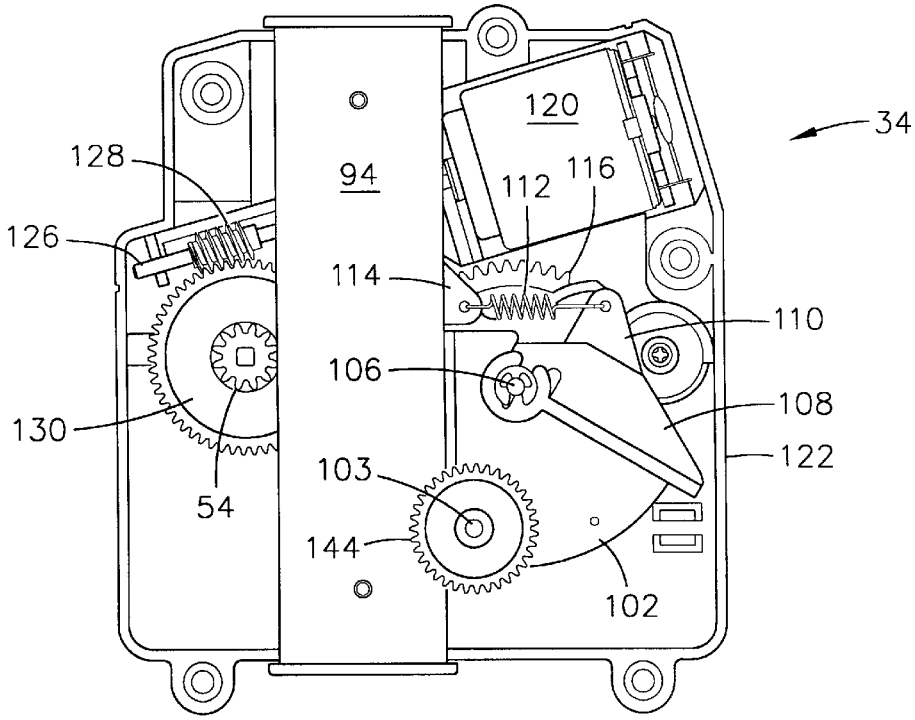
FIG. 12 is a vertical sectional view of the trolley taken along line 12—12 of FIG. 6 showing the boom extender module in place inside of the trolley.
Figure 13:
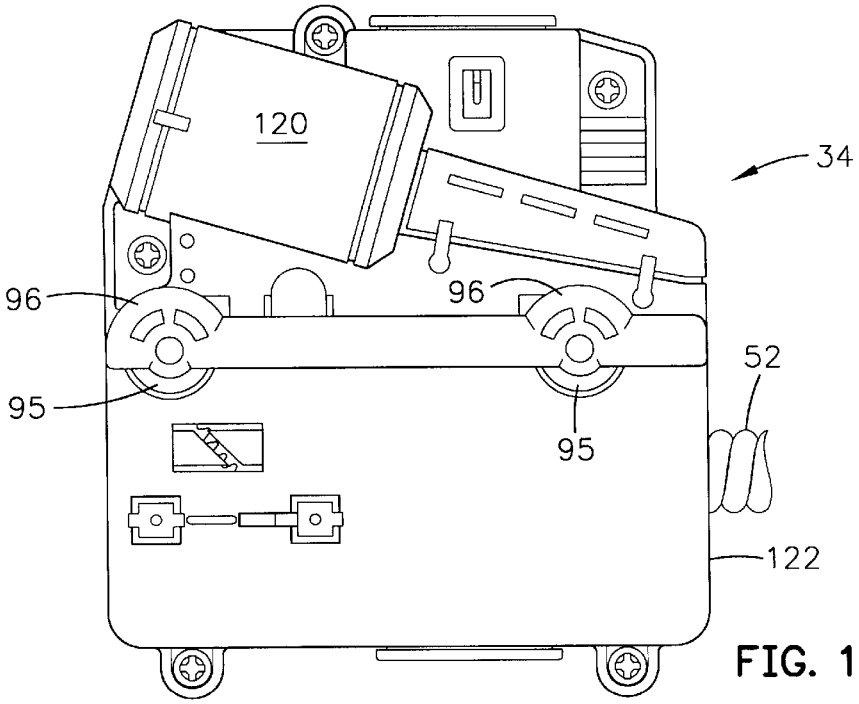
FIG. 13 is a side elevation view of the exterior of the trolley taken from the right side of FIG. 7.

Further details of the mounting of the motor 120 that drives the trolley 34 back and forth along the jib 12 are visible in FIGS. 12 and 13. The motor 120 is mounted on one side of the trolley 34 so that the shaft 126 extends outside the guide sleeve 94 that accommodates the boom 36. Another electrical drive unit including motor 136 (FIG. 11) is mounted inside the trolley 34 for raising and lowering the boom 36. As seen in FIG. 11, the motor 136 is vertically oriented and is connected, through a coupling 138, to a shaft 140. A worm gear 142 mounted on the lower end of the shaft 140 engages and drives a spur gear 144 (FIGS. 8, 12 and 14). The spur gear 144 is mounted on one end of the shaft 103. The other end of the shaft 103 has a pinion gear (not visible) which engages the spur gear 116 to drive the cog 44.

Figure 18:
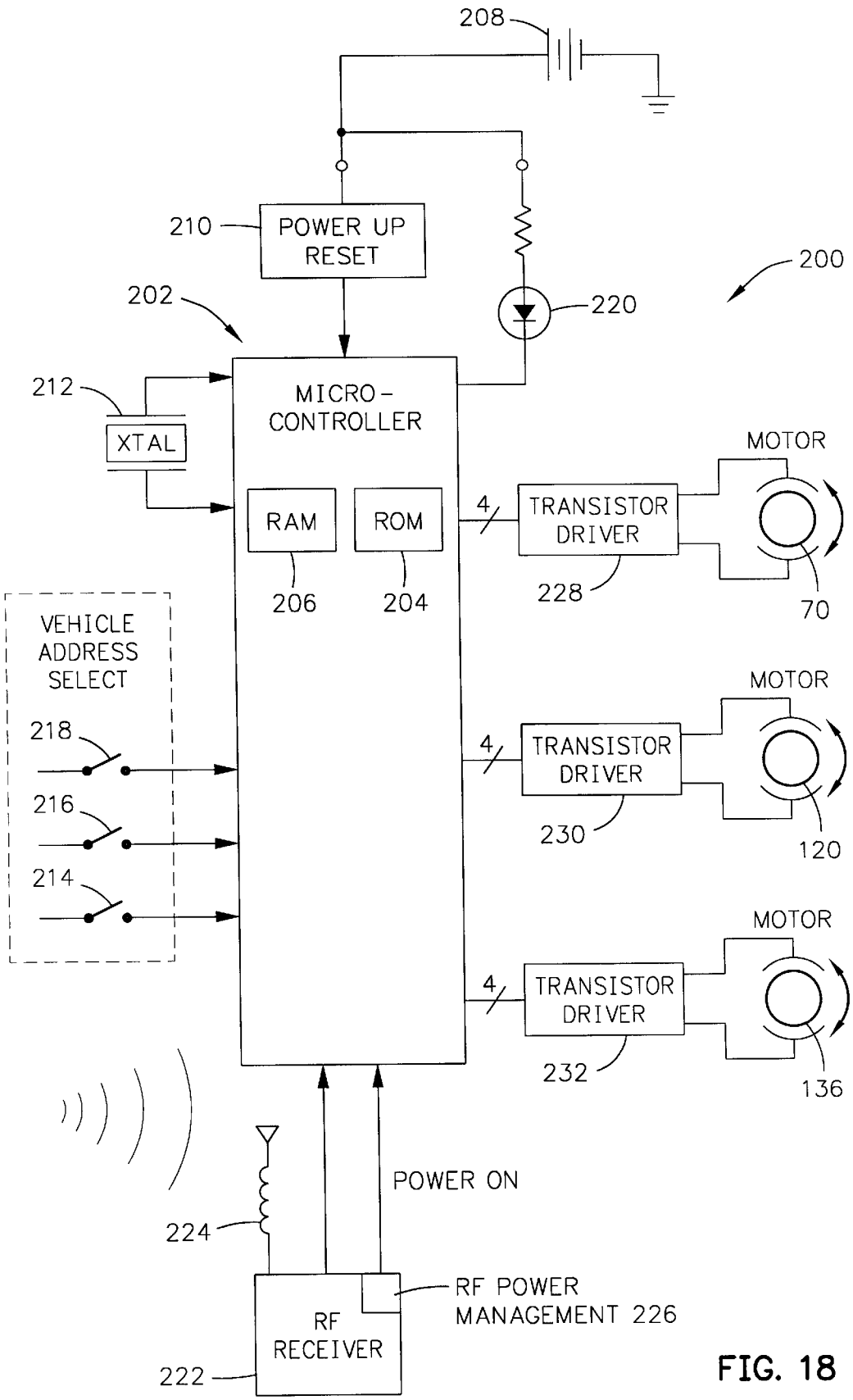
FIG. 18 is a functional block diagram of the control circuit of the tower crane of FIG. 1.

FIG. 18 illustrates the control circuit 200 of the preferred embodiment of our rotary tower crane 10. The control circuit 200 is preferably mounted on one or more circuit boards enclosed inside the outer end of the counterjib 14. The control circuit 200 includes a micro-controller 202 that incorporates a read-only-memory (ROM) 204 and a random access memory (RAM) 206. A plurality of batteries 208 provide power to the micro-controller 202 through a power-up reset circuit 210. As shown in FIG. 3, the batteries 208 are mounted in the outer end of the counterjib 14 and serve as a counter-weight to the load lifted by the boom 36. Referring again to FIG. 18, timing information is provided to the micro-controller 202 by a crystal 212. A unique color-coded and numbered ROKENBOK key (not illustrated) is inserted into the socket 32 in the counterjib 14. The pattern of closure of a plurality of switches 214, 216 and 218 by the key controls the selection of the tower crane 10 in the ROKENBOK toy system. A light emitting diode (LED) 220 is connected to the micro-controller 202 and is illuminated when the tower crane 10 is selected by one of the hand-held control pads of the ROKENBOK toy system. The LED 220 is mounted in the ROKENBOK key inserted into the socket 32 in the counterjib. An RF receiver 222 having an antenna 224 is coupled to the micro-controller 202. The RF receiver 222 includes an RF power management circuit 226. RF signals from the central station of the ROKENBOK toy system are received by the RF receiver 222 and interpreted by the micro-controller 202. The RF signals not only indicate the selection of the toy crane 10 via one of the hand-held ROKENBOK control pads connected to the central station, but also subsequently, commands for rotating the jib 12, moving the trolley 34, and extending or retracting the boom 36. The micro-controller 202 interprets commands communicated by the player via actuation of the rocker switch and push button switches on the hand-held ROKENBOK control pad and thereafter the micro-controller 202 sends the appropriate signals to transistor drivers 228, 230 and 232 for turning the shafts of motors 70, 120 and 136 in the appropriate direction and the appropriate amount. The ROKENBOK toy system permits up to four motors to be controlled in a given vehicle or stationary machine. Accordingly, the control circuit 200 could be provided with an additional transistor driver to control an additional motor (both not illustrated).

Energization of the motor 70 (FIGS. 3, 4 and 18), which forms part of the slewing unit 16, rotates the jib 12 to a predetermined angular position relative to the tower 24. Energization of the motor 120 (FIG. 13) moves the trolley 34 to the appropriate longitudinal position along the jib 12, establishing the radial location of the boom 36. Energization of the motor 136 (FIG. 11) raises and lowers the boom 36 the desired amount.

While a preferred embodiment of our invention has been described in detail, in the form of a radio-controlled toy rotary tower crane, our invention is not limited to toys, or to tower cranes. For example, our method of utilizing of a rigid vertically reciprocable load lifting boom could be applied to a gantry crane, and other useful machines. In addition, our boom extender module could be used outside of a crane or other piece of construction equipment. It could be used in any environment requiring a compact electrical unit for extending and retracting a rigid elongate member. Therefore, the protection afforded our invention should only be limited in accordance with the scope of the following claims.

What is claimed is:

1. A tower crane, comprising:

a tower extending in a vertical direction;

a jib extending in a horizontal direction;

a counterjib extending in the horizontal direction;

a slewing unit mounted to an upper end of the tower for powered rotation of the jib and the counterjib about a vertical axis;

a first electrical drive unit for powering the slewing unit to rotate the jib to a selected angular position relative to the tower;

a trolley movable longitudinally along the jib;

a second electrical drive unit for moving the trolley to a selected longitudinal position along the jib;

a load lifting boom;

a third electrical drive unit mounted on the trolley for extending and retracting the boom in the vertical direction; and a load handler mounted to a lower end of the boom.

2. The tower crane of claim 1 and further comprising a control circuit for independently energizing the first, second and third electrical drive units.

3. The tower crane of claim 2 wherein the control unit includes an RF receiver for receiving commands for independently energizing the first, second and third electrical drive units.

4. The tower crane of claim 3 and further comprising a key socket connected to the control circuit for receiving a key to allow the control circuit to be selected and thereafter commanded via a hand-held control pad that causes a central station to send predetermined selection and control commands.

5. The tower crane of claim 4 and further comprising a source of illumination connected to the control circuit which is energized when the control circuit has been selected.

6. The tower crane of claim 2 wherein the control circuit includes a plurality of batteries for selectively energizing the first, second and third electrical drive units.

7. The tower crane of claim 6 wherein the batteries are mounted in the counterjib to provide a counterweight to a load lifted by the load lifting boom.

8. The tower crane of claim 1 wherein the boom is configured to form a rack gear which is driven by the third electrical drive unit.

9. The tower crane of claim 1 wherein the load handler is selected from the group consisting of a clam-shell bucket, a load lifting platform and a pair of claws.

10. The tower crane of claim 1 wherein an inner end of the counterjib is supported by the slewing unit.

11. A radio-controlled toy rotary tower crane, comprising:

a tower extending in a vertical direction;

a jib extending in a horizontal direction;

a counterjib having an inner end connected to an inner end of the jib and extending in the horizontal direction;

a trolley movable along the jib;

a slewing unit mounted to an upper end of the tower for powered rotation of the jib and the counterjib about the vertical axis;

a first electrical drive unit for powering the slewing unit to rotate the jib and the counterjib to a selected angular position relative to the tower;

a second electrical drive unit for moving the trolley to a selected longitudinal position along the jib;

an elongate rigid load maneuvering boom configured with a plurality of equally longitudinally spaced openings;

a third electrical drive unit mounted on the trolley for extending and retracting the load maneuvering boom in a vertical direction;

a control circuit having an RF receiver for receiving commands for independently energizing the first, second and third electrical drive units, the control circuit including a plurality of batteries for selectively energizing the first, second and third electrical drive units, the batteries being mounted in the counterjib to provide a counterweight to a load lifted by the load maneuvering boom;

a key socket connected to the control circuit for receiving a key to allow the control circuit to be selected and thereafter commanded via a hand-held control pad that causes a central station to send predetermined selection and control commands; and a load handler mounted to a lower end of the load maneuvering boom, the load handler being selected from the group consisting of a clam-shell bucket, a load lifting platform and a claw trap.

12. A crane, comprising:

a jib extending in a horizontal direction;

a trolley movable along the jib in a longitudinal direction;

a first drive unit for moving the trolley to a selected longitudinal position along the jib;

an elongate rigid load maneuvering boom;

a second drive unit mounted on the trolley for extending and retracting the boom in a vertical direction; and a load handler mounted to a lower end of the boom.

13. The crane of claim 12 and further comprising a tower extending in a vertical direction for supporting the jib.

14. The crane of claim 13 and further comprising a counterjib having an inner end connected to an inner end of the jib and extending in the horizontal direction.

15. The crane of claim 14 and further comprising a slewing unit mounted to an upper end of the tower for powered rotation of the jib and the counterjib about the vertical axis.

16. The crane of claim 15 and further comprising a third drive unit for powering the slewing unit to rotate the jib to a selected angular position relative to the tower.

17. The crane of claim 16 and further comprising a control circuit having an RF receiver for receiving commands for independently energizing the first, second and third drive units.

18. The crane of claim 17 wherein the first, second and third drive units include electric motors and the control circuit includes a plurality of batteries for selectively energizing the first, second and third drive units, the batteries being mounted in the counterjib to provide a counterweight to a load lifted by the load maneuvering boom.

19. The crane of claim 17 and further comprising a key socket connected to the control circuit for receiving a key to allow the control circuit to be selected and thereafter commanded via a hand-held control pad that causes a central station to send predetermined selection and control commands.

20. The crane of claim 12 wherein the load maneuvering boom is configured with a plurality of equally longitudinally spaced openings for individually receiving a plurality of teeth of a cog driven by the third drive unit.

21. The crane of claim 12 wherein the load handler is selected from the group consisting of a clam-shell bucket, a load lifting platform and a claw trap.

* * * * *